US007013099B2

(12) United States Patent
Shirakata

(10) Patent No.: US 7,013,099 B2
(45) Date of Patent: Mar. 14, 2006

(54) IMAGE FORMING APPARATUS

(75) Inventor: Jiro Shirakata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/792,948

(22) Filed: Mar. 3, 2004

(65) Prior Publication Data

US 2004/0197113 A1 Oct. 7, 2004

(30) Foreign Application Priority Data

Mar. 5, 2003 (JP) ..... 2003-058090

(51) Int. Cl.
*G03G 15/00* (2006.01)

(52) U.S. Cl. ..... 399/92; 355/200

(58) Field of Classification Search ..... 399/92, 399/93, 94; 355/200
See application file for complete search history.

(56) References Cited

U.S. PATENT DOCUMENTS 4,248,520 A * 2/1981 Kurita et al. ..... 399/92
5,471,280 A * 11/1995 Taguchi ..... 399/330
6,021,290 A * 2/2000 Hamada et al. ..... 399/92
6,240,265 B1 * 5/2001 Noh ..... 399/92
6,882,809 B1 * 4/2005 Hirose et al. ..... 399/92

FOREIGN PATENT DOCUMENTS

JP 2000-187408 A 7/2000

* cited by examiner

*Primary Examiner*—Louis Arana
(74) *Attorney, Agent, or Firm*—Canon U.S.A. INC I.P. Division

(57) ABSTRACT

An image forming apparatus includes an unfixed-image forming unit for forming an unfixed image, and a fixing unit. The fixing unit includes a heating member for heating the unfixed image, and a heat insulating member having an interval with the heating member and disposed so as to cover the heating member along the heating member in a direction perpendicular to a conveying direction of a recording material, for insulating heat from the heating member. The fixing unit is detachably mountable in the image forming apparatus, and fixes the unfixed image on the recording material formed by the unfixed-image forming unit. The apparatus also includes an exhaust fan disposed near the fixing unit, for exhausting air from within the image forming apparatus. The fixing unit has a ventilation channel passing through the fixing unit outside of the heat insulating material.

15 Claims, 5 Drawing Sheets

IMAGE FORMING APPARATUS

BACKGROUND OF THE INVENTION

1. Field of the Invention

The present invention relates to an image forming apparatus.

2. Description of the Related Art

An electrophotographic image forming apparatus usually includes a fixing device in which a toner, made of resin, a magnetic material, a coloring agent and the like, that is electrostatically held on a transfer material is fused and fixed by applying heat and pressure while grasping and conveying the transfer material and the toner at a pressing portion (nip portion) between heating means (a roller, an endless belt, or the like) and pressing means (a roller, an endless belt, or the like).

The configuration and the operation of a heating fixing unit, serving as a conventional fixing device, and the configuration and the operation of a color copier, serving as an image forming apparatus having the heating fixing unit will now be described with reference to FIGS. 4 and 5.

FIG. 4 is a cross-sectional view illustrating an original-reader unit 50, an original-reading device 52, and a principal portion of a printer unit 20 of a color copier.

The original-reader unit 50 provides electronic data by reading an original placed on an upper surface thereof, and includes a first mirror unit 50*a*, a second mirror unit 50*b*, a lens 50*c*, a CCD (charge coupled device) 51*c*, and a platen 50*e*.

The printer unit 20 for printing electronic data obtained by the original-reader unit 50 includes a sheet feeding unit 40, an image forming unit disposed above the sheet feeding unit 40, a heating fixing unit 36, an exhaust fan 55 for preventing heat transfer from the heating fixing unit 36 to the image forming unit and exhausting air within the apparatus, and a sheet discharge unit having a discharged-sheet tray 45.

The image forming unit includes a photosensitive drum 30 capable of rotating by a driving mechanism, around which a rotating developing member 34 incorporating a magenta developing unit 34*a*, a cyan developing unit 34*b*, a yellow developing unit 34*c*, and a black developing unit 34*d*, an intermediate transfer belt 35, a belt cleaner 35*a* that is usually separated from the intermediate transfer belt 35 except immediately after image formation, a cleaner 31, charging means 32, and an optical scanning device 33 for projecting a laser beam onto the photosensitive drum 30 are disposed.

Next, the operation of the color copier having the above-described configuration will be described.

The operator intending to copy an original using the color copier first mounts the original on an original tray 52*a*, and then causes the color copier to operate by depressing a start key (not shown) provided on the original-reader unit 50.

The color copier that has started the operation feeds the original onto the upper surface of the platen 50*e* using the original-reading device 52, scans the entire surface of the original using the first mirror unit 50*a* moving from the left to the right, and discharges the original onto the discharged-sheet tray 52*b*.

The image scanned by the first mirror unit 50*a* is guided to the CCD 51 via the second mirror unit 50*b* and the lens 50*c*, is converted into electronic data by the CCD 51*c*, and the electronic data is transmitted to the printer unit 20.

The printer unit 20 transfers images made of necessary ones of a magenta toner, a yellow toner, a cyan toner and a black toner onto a sheet fed from the sheet feeding unit 40 in a superposed state, to provide a color image. The details of a transfer process in a case of using all of four colors will now be described.

The printer unit 20 first causes the magenta developing unit 34*a* to face the photosensitive drum 30 by rotating the rotating developing member 34.

Then, the photosensitive drum 30 and the intermediate transfer belt 35 are rotatably driven at the same constant circumferential speed by a driving source.

After uniformly charging the surface of the photosensitive drum 30 by the charging means 32, a laser beam 33*f* from the optical scanning device 33 is projected onto the surface of the photosensitive drum 30 to form an electrostatic latent image for a magenta color. This electrostatic latent image is developed as a magenta toner image by receiving a magenta toner from the magenta developing unit 34*d*, and is transferred onto the intermediate transfer bent 35.

Magenta toner particles remaining on the photosensitive drum 30 without being transferred onto the intermediate transfer belt 35 are cleaned by the cleaner 31.

After thus completing development of a magenta image, the rotating developing member 34 rotates to dispose the cyan developing unit 34*a* at a position facing the photosensitive drum 30. A cyan toner image is transferred onto the intermediate transfer belt 35 so as to be superposed on the magenta toner image in the same procedure as for the magenta toner image. Then, the yellow developing unit 34*c* and the black developing unit 34*d* are caused to sequentially face the photosensitive drum 30, and a yellow toner image and a black toner image are formed on the intermediate transfer belt 35 so as to be superposed on the previously transferred toner images.

After transferring the four color, i.e., magenta, cyan, yellow and black, toner images transferred on the intermediate transfer belt 35 in the above-described manner onto the sheet fed from the sheet feeding unit 40 as a recording material, toner particles remaining on the intermediate transfer belt 35 are scraped by causing the belt cleaner 35*a* to contact the intermediate transfer belt 35.

After transferring the color toner image onto the sheet, the printer unit 20 fixes the color toner image on the sheet using the heating fixing unit 36, and then discharges the sheet onto the discharged-sheet tray 45 to terminate the operation.

Next, the conventional fixing unit 36 will be described in detail. As shown in FIG. 4, the fixing unit 36 is disposed near the exhaust fan 55.

As shown in FIG. 5, the fixing unit 36 includes a pair of a fixing roller 61 and a pressing roller 62, each provided by forming a rubber layer on the surface of a core roller. By pressing the pressing roller 62 against the fixing roller 61, a nip portion 63 is formed. The fixing unit 36 is detachably mountable in the main body of the image forming apparatus.

A heater 64 is disposed inside the fixing roller 61, and the fixing roller 61 is maintained at a set temperature by a control device.

When the fixing unit 36 is operating, the sheet conveyed from below is conveyed by being grasped at the nip portion 63 between the fixing roller 61 and the pressing roller 62, and the toner image is fixed by being heated by the fixing roller 61.

Case members 65 and 66 are disposed along the surfaces of the fixing roller 61 and the pressing roller 62, respectively, with an interval of 2–3 mm from the surfaces of these rollers. Intervals between the fixing roller 61 and the pressing roller 62, and the case members 65 and 66 are termed interval portions 67 and 68, respectively.

The case members 65 and 66 are made of a resin material having a high heat insulating property. By thus covering the fixing rollers 61 and the pressing roller 62 with the case members 65 and 66, respectively, with a small interval, it is possible to efficiently perform heat insulation for the fixing roller 61 and the pressing roller 62. As proposed in Japanese Patent Application Laid-Open No. 2000-187408, heat insulation for the fixing roller 61 and the pressing roller 62 can be improved by using the case members 65 and 66, respectively.

However, when the fixing roller 61 and the pressing roller 62 are covered with the case members 65 and 66, respectively, with a small interval, air is also sucked from the fixing unit 36 by the exhaust fan 55 provided near the fixing unit 36. Since a space for an entrance to the fixing nip portion for the recording material, a sheet discharge outlet, and the like is necessary in the fixing unit 36, it is difficult to completely close the fixing unit 36. Accordingly, for example, air enters from the entrance, and flows to the outlet through an interval between the fixing roller 61 and the heat insulating material.

As described above, since air present near the surfaces of the rollers 61 and 62 directly moves at interval portions 67 and 68, temperature tends to change at the surfaces of the rollers 61 and 62, resulting in cooling of the fixing roller 61 and the pressing roller 62.

By providing another ventilation channel near the heat insulating material, movement of air at the interval between the fixing roller 61 and the heat insulating material can be reduced by increasing movement of air at the ventilation channel.

However, in order to provide such an another ventilation channel in the main body of the image forming apparatus when mounting the fixing unit, it is necessary to newly mount a plurality of components in the image forming apparatus, resulting in an increase in the number of components in the main body of the image forming apparatus, and a complicated configuration.

SUMMARY OF THE INVENTION

It is an object of the present invention to reduce the number of components in an image forming apparatus.

It is another object of the present invention to prevent cooling of a heating member due to an air flow.

According to one aspect of the present invention, an image forming apparatus includes unfixed-image forming means for forming an unfixed image, a fixing unit that includes a heating member for heating the unfixed image, and a heat insulating member having an interval with the heating member and disposed so as to cover a part of the heating member along the heating member in a direction perpendicular to a conveying direction of a recording material, for insulating heat from the heating member, detachably mountable in the image forming apparatus, for fixing the unfixed image on the recording material formed by the unfixed-image forming means, and an exhaust fan disposed near the fixing unit, for exhausting air from within the image forming apparatus. The fixing unit includes a ventilation channel passing through the fixing unit outside of the heat insulating member.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now be described in detail with reference to the drawings. However, unless not particularly mentioned, the scope of the present invention is not limited to the size, the material, the shape and the relative displacement of each component described in each of the embodiments.

(First Embodiment)

A first embodiment of the present invention will now be described with reference to FIGS. 1, 2 and 4.

Figure 4:
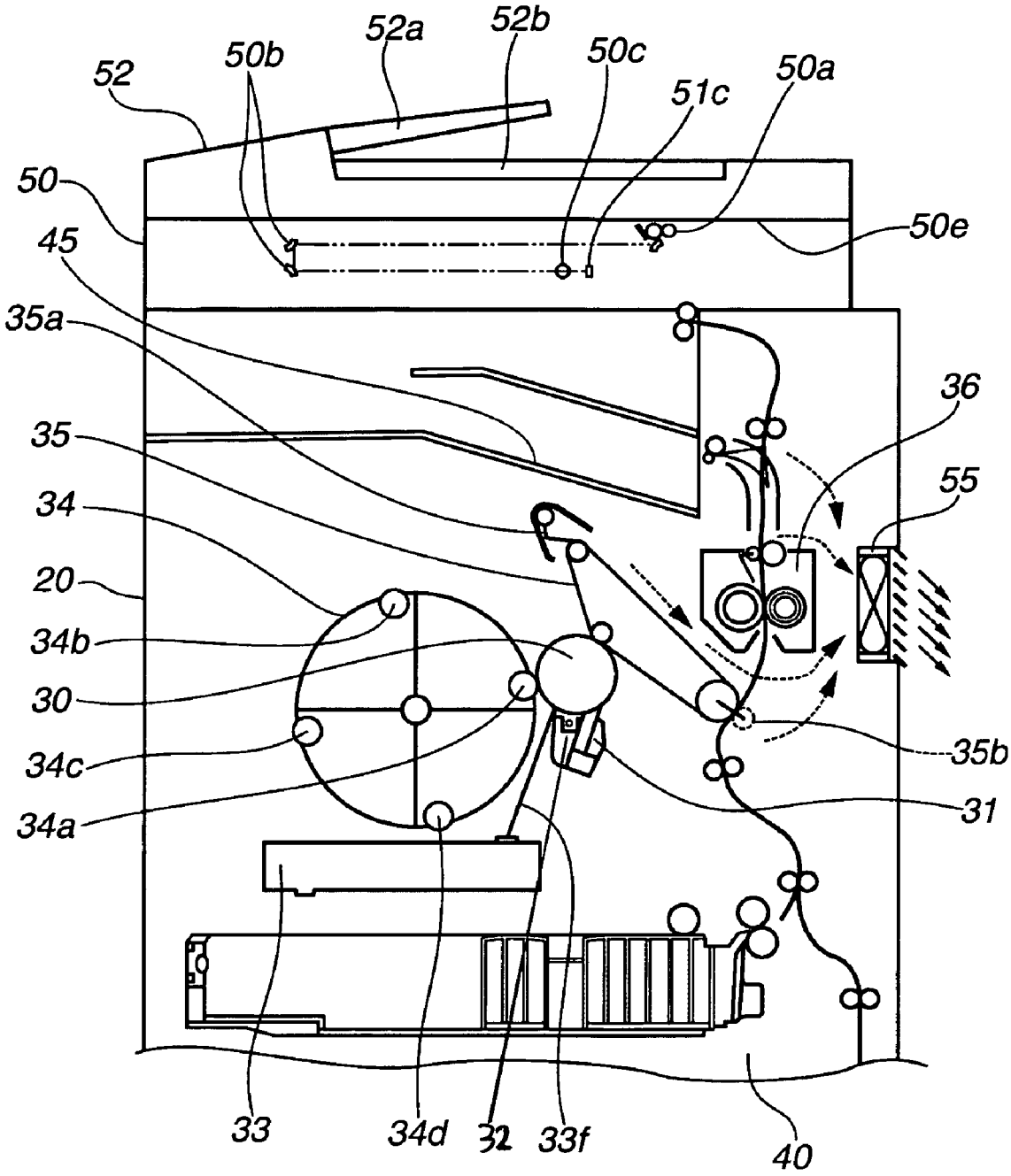
FIG. 4 is a schematic cross-sectional view illustrating a color copier.
Figure 5:
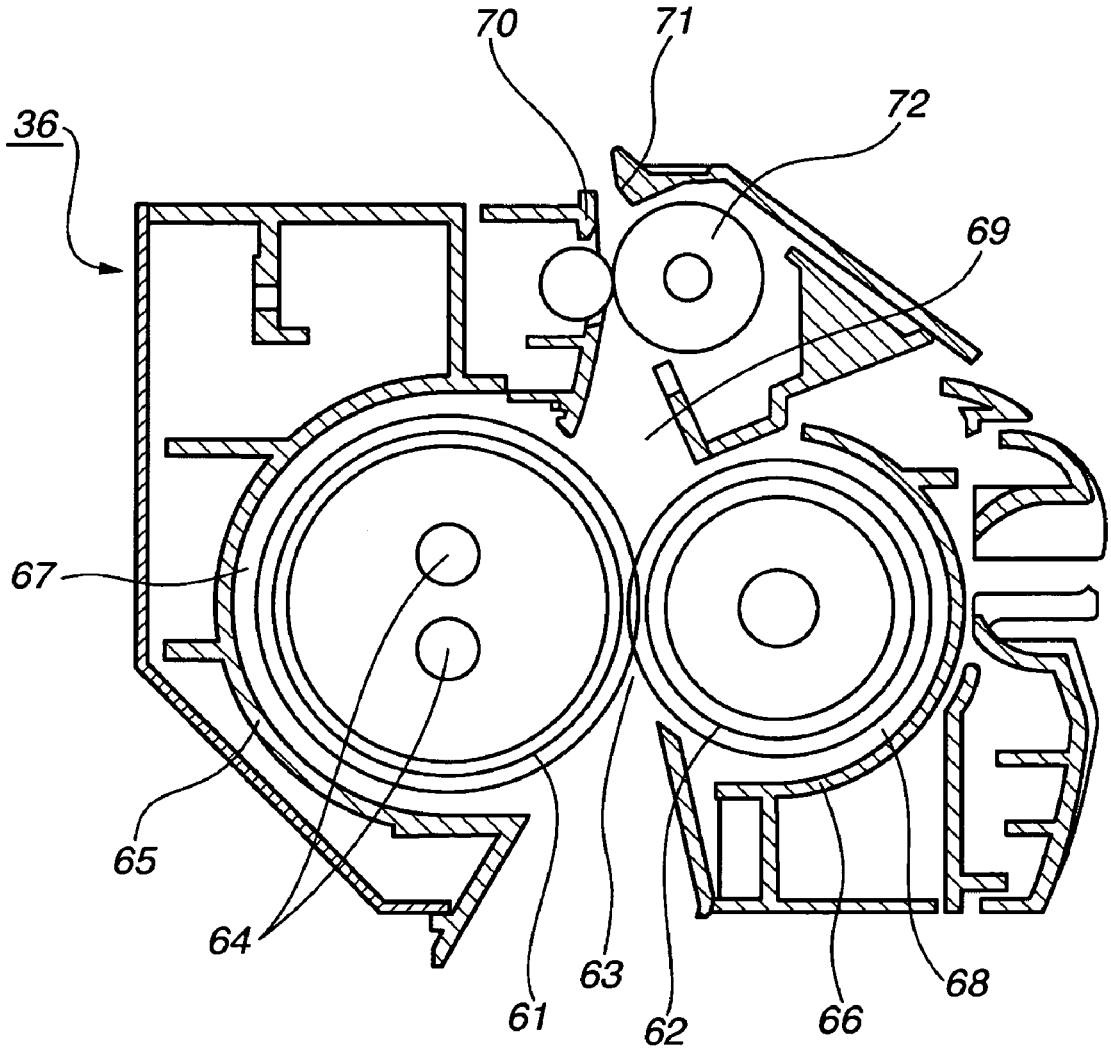
FIG. 5 is a schematic cross-sectional view illustrating a heating fixing unit.

FIG. 4 illustrates a color copier, serving as an image forming apparatus mounting a heating fixing unit, serving as a fixing device, according to the first embodiment.

The configuration of the color copier of the first embodiment is the same as the above-described one. As shown in FIG. 4, the color copier includes an original-reader unit 50, an original-reading device 52, and a printer unit 20 to form an image on a recording material. The printer unit 20 has the same configuration as the above-described one, except for a fixing unit 36 to which the present invention is applied. Accordingly, the fixing unit 36 of the first embodiment will now be described.

Figure 1:
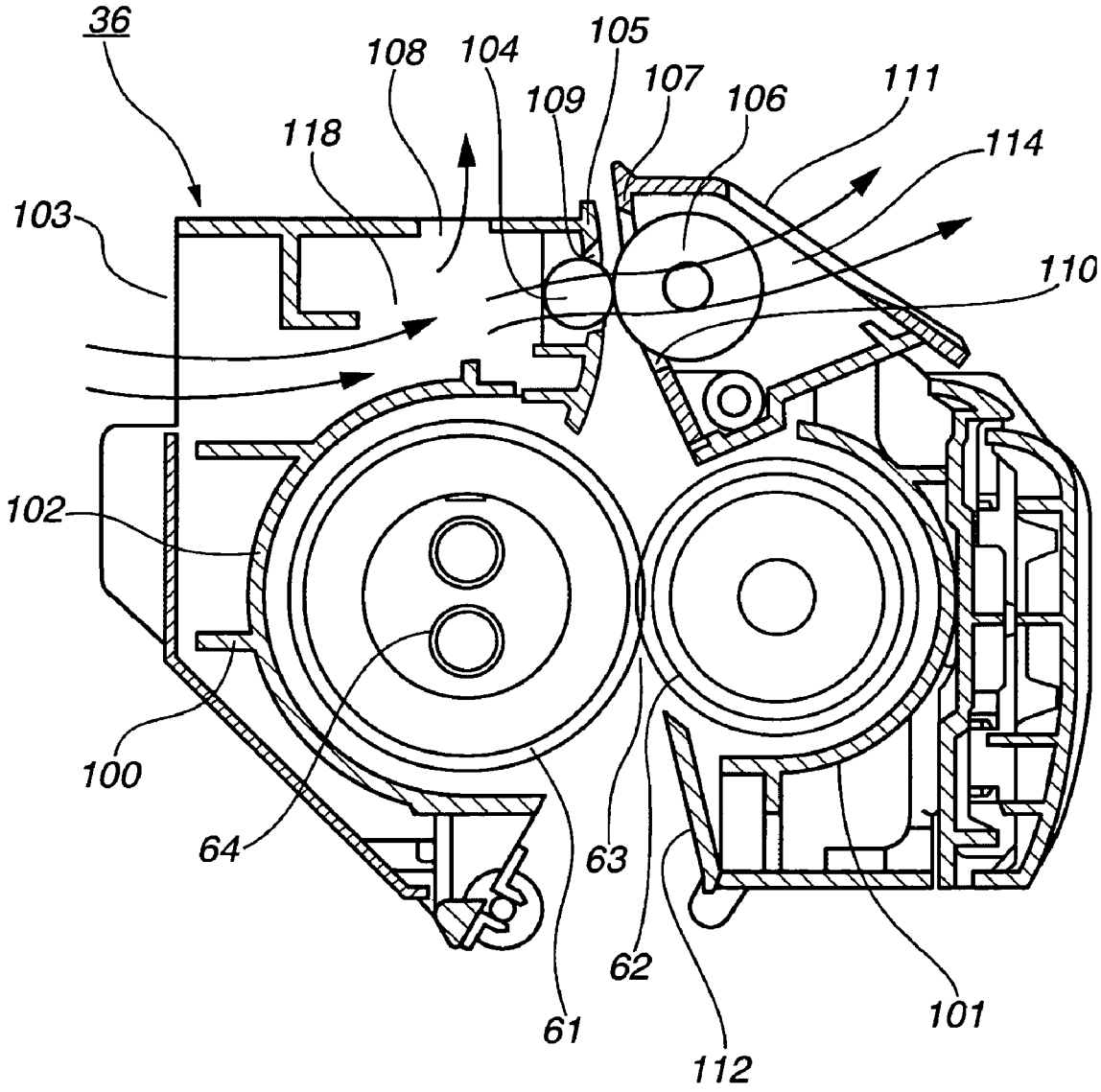
FIG. 1 is a schematic cross-sectional view illustrating a heating fixing unit according to a first embodiment of the present invention.

As shown in FIG. 1, the fixing unit 36 includes a pair of a fixing roller 61, serving as a heating member provided by forming a rubber layer on the surface of a core, and a pressing roller 62, serving as a pressing member to be brought in pressure contact with the fixing roller 61. By pressing the pressing roller 62 against the fixing roller 61, a nip portion 63 for grasping and conveying a recording material is formed. The fixing roller 61 and the pressing roller 62 constitute heating means. In the fixing unit 36 of the first embodiment, a pair of discharge rollers 104 and 106, an entrance guide 112 for guiding the recording material to the nip portion 63, and a conveying guide 105 are integrated together with the above-described pair of rollers 61 and 62, so as to be detachably mountable in the image forming apparatus.

A halogen-lamp heater 64 is disposed within the fixing roller 61, and the amount of current supply to the heater 64, serving as a heater, is controlled by control means so that the temperature of the fixing roller 61 is maintained at a set temperature, in accordance with an output of a temperature detecting member, for example thermistor, serving as a contact-type or non-contact-type temperature detector.

When the fixing unit 36 is operating, a sheet, serving as a recording material, conveyed from below is conveyed by being grasped at the nip portion 63 between the fixing roller 61 and the pressing roller 62, and a toner image is fixed by heat by the fixing roller 61 and the pressing roller 62.

Case members 100 and 101, each serving as a heat insulating member, are disposed along the surfaces of the fixing roller 61 and the pressing roller 62, respectively, with a small interval of 2-3 mm from the surfaces of these rollers. Interval portions are formed between the fixing roller 61 and the pressing roller 62, and portions of the case members 100 and 101 along the surfaces of the rollers 61 and 62, respectively.

The case members 100 and 101 are made of a resin material having a high heat insulating property. By thus covering the fixing roller 61 and the pressing roller 62 with the case members 100 and 101 with a small interval at the portions along the surfaces of the rollers 100 and 101, respectively, it is possible to efficiently perform heat insulation for the fixing roller 61 and the pressing roller 62. The case members 100 and 101 are formed integrally with part of the frame shown in FIG. 2. By using a heat insulating member for at least a portion disposed along the longitudinal direction of the fixing roller 61 with an interval with the fixing roller 61, the heat insulating property of the fixing roller 61 can be improved. It is preferable to adopt the same configuration for the pressing roller 62.

A pair of conveying rollers 104 and 106 held by the case members 100 and 101 are disposed at portions above the fixing rollers 61 and the pressing roller 62, respectively, as conveying means for conveying the sheet after fixing.

A ventilation portion for forming a ventilation channel is provided at the case member 100. That is, by providing a space 118 between the frame of the fixing unit 36 and the heat insulating portion for the fixing roller 61, a ventilation channel is formed. An opening 103 over substantially the entire region of the fixing roller 61 in the longitudinal direction is formed above a cover portion 102 along the fixing roller 61 as a ventilation-channel entrance. An opening 108 over substantially the entire region in the longitudinal direction is provided above the case member 100 as a ventilation-channel outlet. As shown in FIG. 1, in the first embodiment, the ventilation channel having the opening 103 as an entrance and the opening 108 as an outlet is formed. By thus newly providing the ventilation channel within the fixing unit 36, it is possible to hinder concentration of an air flow into a small gap between the fixing roller 61 and the heat insulating member where ventilation is difficult, and reduce an air flow on the surface of the heating member. The new ventilation channel preferably has a space as large as possible, because much air can flow. A substance hindering the flow of air is preferably as small as possible in the ventilation channel.

Figure 2:
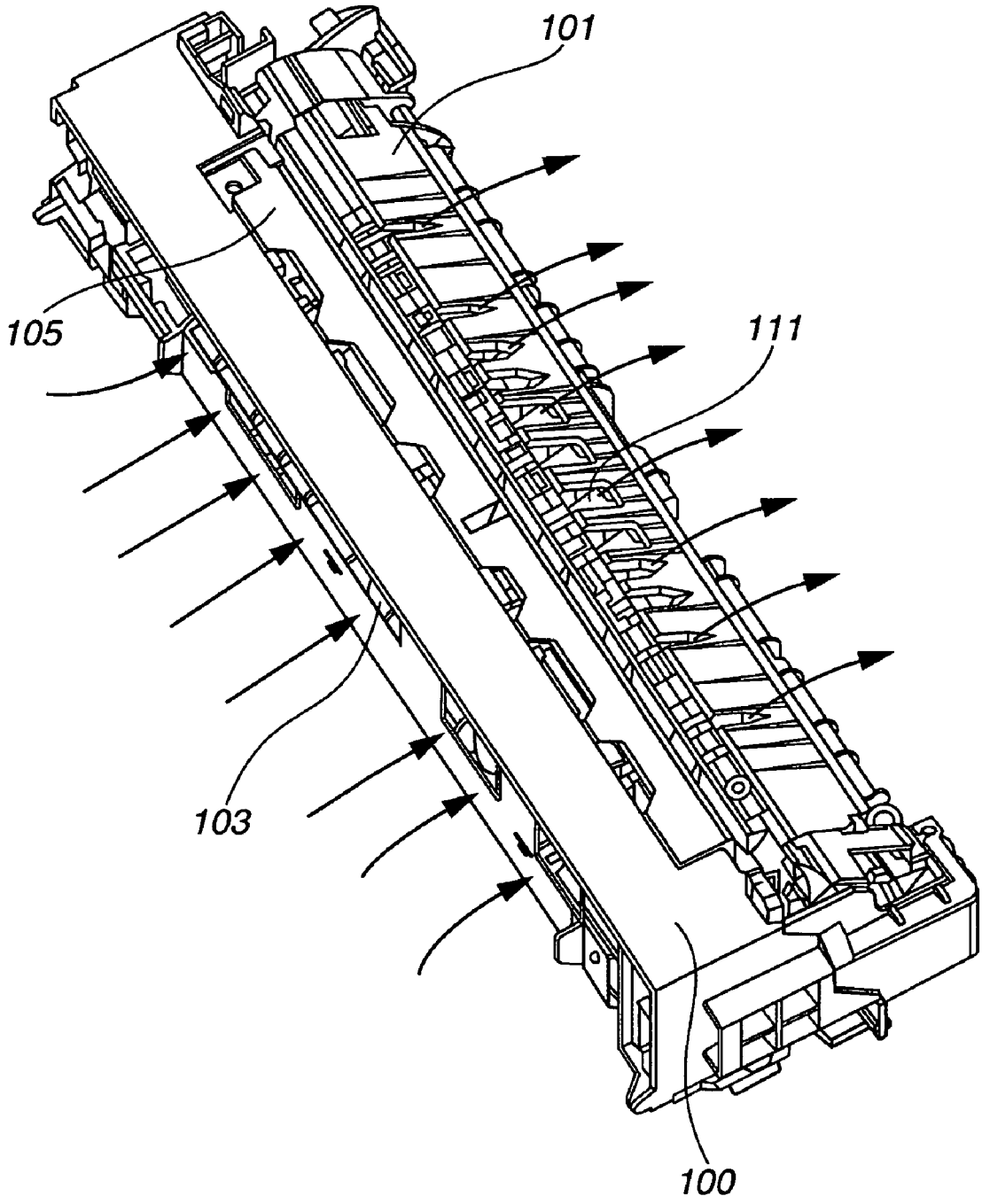
FIG. 2 is a schematic perspective view illustrating the heating fixing unit shown in FIG. 1.

According to the first embodiment, as shown in FIG. 2, by providing openings at the frame of the fixing unit 36, a ventilation channel can be provided without increasing the number of components. That is, by using a mold to provide a space and openings when performing resin molding, a ventilation channel can be formed with a small number of components.

When heating means is covered with the case member 101 and 102 having a high heat insulating property, heat of the heating means is accumulated at a gap portion. As the time elapses, the convection of the accumulated heat is concentrated to a portion where the case members 101 and 102 do not cover, for example, a sheet conveying space above the nip portion 63 in a configuration in which the recording material is discharged in a longitudinal direction. As a result, an excessive temperature rise occurs at conveyance guides 105 and 107 for guiding the sheet, and a pair of conveying rollers 106, 104. In the first embodiment, such an excessive temperature rise can be prevented, as shown in the following configuration.

An opening 109 is also provided over substantially the entire region of the conveying guide 105, serving as a guide member, where the conveying roller 104, serving as a recording-material conveying member, of the case member 100 is disposed, in the longitudinal direction around the conveying roller 104.

An opening 110 is also provided over substantially the entire region of a conveying guide 107, serving as a guide member, having the conveying roller 106 of the case member 101, in the longitudinal direction around the conveying roller 106. A space 114 is provided between the heat insulating member for the pressing roller 62 and the frame of the fixing unit 36.

An opening 111 over the entire region in the longitudinal direction is also provided above the case member 101.

As a result, the air flow generated at the exhaust fan 55 shown in FIG. 4 enters the case member 100 from the opening 103, and part of the air flow goes out from the opening 108. Another air flow entering the case member 100 from the opening 103 goes out from the opening 109 of the case member 100, enters the case member 101 from the opening 110, and goes out from the opening 111 via the space 114. Thus, an air channel is formed.

The air channel is provided above the fixing roller 61 and the pressing roller 62 by passing through the conveying guides 105 and 107 from the openings 109 and 110 present at part of the conveying guides 105 and 107, serving as conveyance guiding members, and passing around the conveying rollers 104 and 106 disposed near the openings 109 and 110, respectively.

Since the air channel is formed in the above-described manner, for example, most of an air flow generated by the exhaust fan 55 shown in FIG. 4 uniformly flows over the entire region in a direction perpendicular to the longitudinal direction above the fixing roller 61 and the pressing roller 62 as indicated by arrows in FIGS. 1 and 2, and suppresses generation of an air flow in the longitudinal direction near the fixing roller 61 and the pressing roller 62.

It is thereby possible to secure desired uniformity of the temperatures of the fixing roller 61 and the pressing roller 62 in the longitudinal direction, and prevent failure in an image and failure in conveyance due to non-uniformity in the temperature.

Since the air channel is formed so as to pass through part of the conveying guides 105 and 107, it is possible to cool the conveying guides 105 and 107 whose temperatures are raised by the fixing roller 61 and the pressing roller 62, respectively, by the air flow flowing in the air channel, and prevent sticking of an image and failure in sheet conveyance.

The conveying guides 105 and 107 are formed near an outlet from which heat accumulated between the fixing roller 61 and the pressing roller 62, and the case members 100 and 101, respectively, goes out. The temperature rise of the conveying guides 105 and 107 are larger than in other portions.

Since the air channel is formed so as to pass through the entire region of the circumferences of the conveying rollers 104 and 106 in the longitudinal direction, it is possible to cool the conveying rollers 104 and 106 whose temperatures are raised by the fixing roller 61 and the pressing roller 62, respectively, by an air flow flowing in the air channel, and prevent sticking of an image and failure in sheet conveyance.

In a configuration in which a recording material is discharged in the longitudinal direction, the air channel is disposed above the nip portion between the fixing roller 61 and the pressing roller 62. Hence, it is possible to cool portions above the fixing roller 61 and the pressing roller 62 whose temperatures tend to be raised by heat radiation from the nip portion, by an air flow flowing through the air channel, and prevent sticking of an image and failure in sheet conveyance.

Although in the first embodiment, an air flow is formed by providing openings, any other configuration, such as ribs or the like, may also be adopted, provided that air can enter and go out. Although in the first embodiment, the fixing unit is disposed so as to discharge a recording material in the longitudinal direction, the fixing unit may be disposed so as to discharge a recording material in the lateral direction. Although in the first embodiment, the pressing roller is used, the same effects may also be obtained even if a pressing method using a pressing belt is adopted.

As described above, in the fixing unit 36 of the first embodiment, it is possible to provide compatibility of the heat insulating property and uniformity in the temperature in the longitudinal direction of the fixing roller 61 and the pressing roller 62. Furthermore, by providing a ventilation channel passing through the conveying guides 105 and 107, and the conveying rollers 104 and 106, respectively, whose temperatures tend to be excessively raised, it is possible to efficiently cool these members, and realize excellent image formation and conveying property with a simple configuration.

As described above, according to the present invention, it is possible to realize a ventilation channel only by providing a ventilation entrance and a ventilation outlet, and a space between a heat insulating member for a heating member and the frame of a fixing unit in the frame of the fixing unit, and reduce an air flow between the heating member and the heat insulating member without increasing the number of components of an image forming apparatus.

(Second Embodiment)

A second embodiment of the present invention will now be described with reference to FIGS. 3 and 4. As in the first embodiment, a fixing unit 36 of the second embodiment is mounted in the color copier shown in FIG. 4, or the like. The fixing unit 36 of the second embodiment will now be described.

Figure 3:
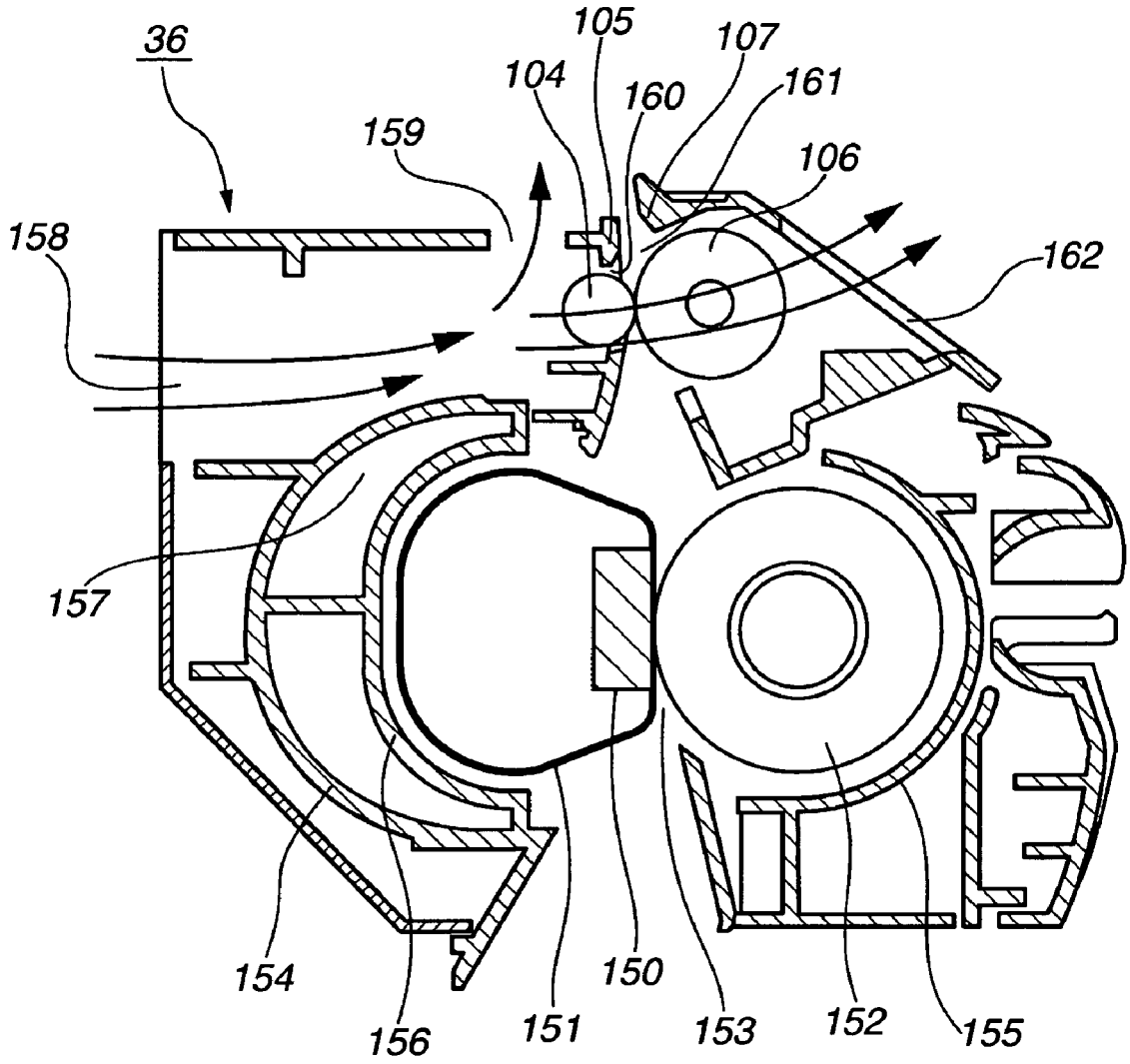
FIG. 3 is a schematic cross-sectional view illustrating a heating fixing unit according to a second embodiment of the present invention.

As shown in FIG. 3, the fixing unit 36 includes a pair of a film 151, serving as a fixing rotating member, having a ceramic heater 150, serving as a heater, therein, and a pressing roller 152, serving as a pressing member. By pressing the pressing roller 152 against the ceramic heater 150 via the film 151, a nip portion 153 is formed. The film 151 having the ceramic heater 150 and the pressing roller 152 constitute heating means.

When the fixing unit 36 is operating, a sheet conveyed from below is conveyed by being grasped at the nip portion 153 between the film 151 heated by the ceramic heater 150, and the pressing roller 152, and a toner image is fixed by being heated by the film 151.

Case members 154 and 155 are disposed along the surfaces of the film 151 and the pressing roller 152, respectively, with an interval of 2–3 mm from the surfaces of these rollers. Interval portions are formed between the film 151 and the pressing roller 152, and the case members 154 and 155, respectively.

The case members 154 and 155 are made of a resin material having a high heat insulating property. By thus covering the film 151 and the pressing roller 152 with a small interval at portions along the surfaces of the film 151 and the pressing roller 152, it is possible to efficiently perform heat insulation for the film 151 and the pressing roller 152.

A pair of conveying rollers 104 and 106, serving as conveying means for conveying a sheet after fixing, are disposed above the film 151 and the pressing roller 152, respectively.

In the case member 154, a closed space 157 is formed above a cover portion 156 along the film 151, and an opening 158 over substantially the entire region of the film 151 in the longitudinal direction is formed above the closed space 157. An opening 159 over substantially the entire region in the longitudinal direction is also provided above the case member 154.

An opening 160 is also provided over substantially the entire region of a conveying guide 105, serving as a guide member, where the conveying roller 104 of the case member 154 is disposed, in the longitudinal direction around the conveying roller 106.

An opening 161 is also provided over substantially the entire region of a conveying guide 107, serving as a guide member, having a conveying roller 106 of the case member 155, in the longitudinal direction around the conveying roller 106.

An opening 162 is also provided over the entire region in the longitudinal direction above the case member 155.

As a result, the air flow generated at the exhaust fan 55 shown in FIG. 4 enters the case member 154 from the opening 158, and part of the air flow goes out from the opening 159. Another air flow entering the case member 154 from the opening 158 goes out from the opening 160 of the case member 154, enters the case member 155 from the opening 161, and goes out from the opening 162. Thus, an air channel is formed.

The air channel is provided above the film 151 and the pressing roller 152 by passing through the conveying guides 105 and 107 from the openings 160 and 161 present at part of the conveying guides 105 and 107, and passing around the conveying rollers 104 and 106 disposed near the openings 160 and 161, respectively.

Since the air channel is formed in the above-described manner, for example, most of an air flow generated by the exhaust fan 55 shown in FIG. 4 uniformly flows over the entire region in a direction perpendicular to the longitudinal direction above the film 151 and the pressing roller 152 as indicated by arrows shown in FIG. 3, and suppresses generation of an air flow in the longitudinal direction near the film 151 and the pressing roller 152.

It is thereby possible to secure desired uniformity of the temperatures of the film 151 and the pressing roller 152 in the longitudinal direction, and prevent failure in an image and failure in conveyance due to non-uniformity in the temperature.

Since the air channel is formed so as to pass through part of the conveying guides 105 and 107, it is possible to cool the conveying guides 105 and 107 whose temperatures are raised by the film 151 and the pressing roller 152, respectively, by an air flow flowing in the air channel, and prevent sticking of an image and failure in sheet conveyance.

Since the air channel is formed so as to pass through the entire region of the circumferences of the conveying rollers 104 and 106 in the longitudinal direction, it is possible to cool the conveying rollers 104 and 106 whose temperatures are raised by the film 151 and the pressing roller 152, respectively, by an air flow flowing in the air channel, and prevent sticking of an image and failure in sheet conveyance.

The air channel is disposed above the film 151 and the pressing roller 152. Hence, it is possible to cool portions above the film 151 and the pressing roller 152 whose temperatures tend to be raised by heat radiation from the film 151 and the pressing roller 152, by an air flow flowing through the air channel, and prevent sticking of an image and failure in sheet conveyance.

Although in the second embodiment, an air flow is formed by providing openings, any other configuration, such as ribs or the like, may also be adopted, provided that air can enter and go out.

Although in the second embodiment, the configuration of the fixing unit using the fixing roller incorporating the halogen-lamp heater, and the fixing unit for fixing a toner image on a recording material using heat from the heater via the film has been described, the same effects may also be obtained by applying the present invention to an induction heating unit in which an eddy current is generated in a conductive layer of a fixing roller or belt by a magnetic field generated by causing a current to flow in a coil for generating the magnetic field, and the fixing roller or belt is heated by the eddy current.

As described above, in the fixing unit 36 of the second embodiment, it is possible to provide compatibility of the heat insulating property and uniformity in the temperature in the longitudinal direction of the film 151 and the pressing roller 152. Furthermore, it is possible to efficiently cool the conveying guides 105 and 107 and the conveying rollers 104 and 106 whose temperatures tend to be excessively raised, and realize excellent image formation and conveying property with a simple configuration.

As described above, according to the present invention, it is possible to reduce an air flow between a heating member and a heat insulating member without increasing the number of components of an image forming apparatus, even if the configuration of the heating member differs.

The individual components shown in outline in the drawings are all well known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

unfixed-image forming means for forming an unfixed image;

a fixing unit detachably mountable in said image forming apparatus, for fixing the unfixed image on the recording material formed by said unfixed-image forming means, that comprises:

a heating member for heating the unfixed image;

a heat insulating member having an interval with said heating member and disposed so as to cover a part of said beating member along said heating member in a direction perpendicular to a conveying direction of a recording material, for insulating heat from said heating member; and a frame housing the heating member and the heat insulating member therein; and an exhaust fan disposed near said fixing unit, for exhausting air from within said image forming apparatus, wherein said fixing unit has a ventilation channel defined by the heat insulating member and the frame so that air passes through said fixing unit directly between said heat insulating member and the frame.

2. An image forming apparatus according to claim 1, wherein said fixing unit provides a ventilation entrance and a ventilation outlet for forming the ventilation channel outside of said heat insulating member at the frame the of said fixing unit.

3. An image forming apparatus according to claim 2, wherein said ventilation entrance and said ventilation outlet are formed in a direction perpendicular to the conveying direction of the recording material.

4. An image forming apparatus according to claim 1, wherein said fixing unit comprises a pair of sheet discharge rotating members for discharging the recording material, and wherein said pair of sheet discharge rotating members are disposed in the ventilation channel.

5. An image forming apparatus according to claim 1, wherein said fixing unit further comprises a guiding member for guiding the recording material after fixing, and wherein said guide member is disposed in the ventilation channel.

6. An image forming apparatus according to claim 5, wherein said guide member has a plurality of ventilation portions.

7. An image forming apparatus according to claim 1, wherein said heat insulating member is made of resin.

8. An image forming apparatus comprising:

image forming means for forming an image on a recording material;

an image heating unit having a frame and a heating rotary member configured to heat the image on the recording material, wherein the image heating unit includes a heat insulating member located to cover a peripheral surface of the heating rotary member and configured to insulate heat from the heating rotary member;

an exhaust fan, disposed near the image heating unit, exhausting air from within the image forming apparatus; and a ventilation channel facilitating to pass the air, exhausted by-said exhaust fan, therethrough, wherein the ventilation channel is formed between the frame of the image heating unit and the heat insulating member.

9. An image forming apparatus according to claim 8, wherein the ventilation channel is formed at an upper side of the heating rotary member.

10. An image forming apparatus according to claim 8, wherein the image heating unit is detachably mountable to the image forming apparatus.

11. An image forming apparatus according to claim 8, wherein the ventilation channel is formed in a direction perpendicular to a conveying direction of the recording material.

12. An image forming apparatus according to claim 8, wherein the image heating unit comprises a pair of discharge rotating members configured to discharge the recording material heated by the heating rotary member, and wherein the discharge rotating members are disposed in the ventilation channel.

13. An image forming apparatus according to claim 8, wherein the image heating unit comprises a guiding member guiding the recording material heated by the heating rotary member, and wherein the guiding member is disposed in the ventilation channel.

14. An image forming apparatus according to claim 13, wherein the guiding member has a plurality of ventilating openings.

15. An image forming apparatus according to claim 8, wherein the heat insulating member is made of resin.

* * * * *